US007362276B2

(12) United States Patent
Liao et al.

(10) Patent No.: US 7,362,276 B2
(45) Date of Patent: Apr. 22, 2008

(54) HAND-HELD COMMUNICATION DEVICE WITH A ROTATABLE ANTENNA

(75) Inventors: Kuo-Chu Liao, Taipei (TW); Ching-Chung Tang, Taipei (TW); Chung-Yuan Kuang, Taipei (TW)

(73) Assignee: ASUSTeK Computer Inc., Taipei (TW)

( * ) Notice: Subject to any disclaimer, the term of this patent is extended or adjusted under 35 U.S.C. 154(b) by 0 days.

(21) Appl. No.: 11/527,673

(22) Filed: Sep. 27, 2006

(65) Prior Publication Data

US 2007/0080875 A1 Apr. 12, 2007

(30) Foreign Application Priority Data

Sep. 29, 2005 (TW) ..... 94133985 A

(51) Int. Cl.
*H01Q 1/24* (2006.01)

(52) U.S. Cl. ..... 343/702; 343/882

(58) Field of Classification Search ..... 343/702, 343/872, 881, 882
See application file for complete search history.

(56) References Cited

U.S. PATENT DOCUMENTS

2005/0035912 A1* 2/2005 Takagi ..... 343/702
2006/0017626 A1* 1/2006 Kannan et al. ..... 343/702
2006/0022878 A1* 2/2006 Seo et al. ..... 343/702

* cited by examiner

*Primary Examiner*—Tho Phan
(74) *Attorney, Agent, or Firm*—Birch, Stewart, Kolasch & Birch, LLP

(57) ABSTRACT

Hand-held communication device includes a first housing, a rotation axle connected to the first housing in a rotatable manner, a second housing, an antenna installed inside the second housing, and a rod with one end connected to the rotation axle in a rotatable manner and the other end connected to the second housing. The antenna can be positioned to optimize radio frequency signal reception by rotating the rotation axle with respect to the first housing and rotating the rod with respect to the rotation axle.

8 Claims, 8 Drawing Sheets

HAND-HELD COMMUNICATION DEVICE WITH A ROTATABLE ANTENNA

BACKGROUND OF THE INVENTION

1. Field of the Invention

The present invention relates to hand-held communication devices, and more particularly, to a hand-held communication device with a rotatable antenna 2. Description of the Prior Art In recent years, the popularity of the hand-held communication devices continues to rise because of the development and progress of communications techniques. Many people in modern society have at least one hand-held communication device. So-called hand-held communication devices include a large of variety of devices, such as cellular phones and personal data assistants. In spite of these various kinds of the hand-held communication devices having different internal parts corresponding to different functions provided, they basically include an antenna for receiving and transmitting a radio frequency signal, and a transceiver for handling the radio frequency signal. Good radio signal transceiving quality is very important with regard to all kinds of communication devices; therefore, antennas play a very significant role. If an antenna can only receive a weak radio frequency signal from its corresponding direction, then the signal will not be strong enough to be processed by the transceiver. In this way, the communication device will lose its most basic functionality, communication, and other various functions it possesses will become less useful.

Take a hand-held communication device with a global positioning system, for example. Because the antenna applied to such a communication device is a highly directional antenna, meaning that a user needs to point the housing in which the antenna located toward to the signal source for receiving a satellite signal, the prior art includes a rotation axle between the communication device itself and the antenna to improve the reception range of the antenna. The rotation axle provided by the prior art lets the user adjust the direction of the antenna by rotation in two-dimensional space to optimize the strength of the satellite signal. Please refer to FIG. 1 showing a block diagram of a hand-held communication device 10 with a global position system according to the prior art. Such communication device 10 includes a first housing 12, a processor 13 installed inside the first housing 12 for handling data, a transceiver 15 installed inside the first housing 12 and connected to the processor 13 for handling a radio frequency signal, an LCD panel 8 installed inside the first housing 12 for displaying data, a second housing 14, an antenna 11 installed inside the second housing 14, a signal line 17 connected to the antenna 11 and the transceiver 15 for transmitting a radio frequency signal, and a rotation axle 16 connected to the first housing 12 in a rotatable manner. One end of the second housing 14 is fixed to the rotation axle 16 so that the second housing 14 can be rotated with respect to the first housing 12.

The antenna of the communication device above can only rotate in two dimensions, and thus, the range of radio frequency signal reception is limited. Please refer to FIG. 2, which is a block diagram of the hand-held communication device 10 when the second housing 14 is rotated zero degrees. FIG. 3 is a block diagram of the hand-held communication device 10 when the second housing 14 is rotated 180 degrees. Arrows 18 and 22 represent the normal direction of the antenna 11. When the second housing 14 is positioned as shown in FIG. 2 and FIG. 3 and the direction of the satellite signal is parallel with arrows 18, the radio frequency signal reception of the antenna 11 is optimized. However, when the direction transmitted from the satellite signal follows arrows 20 or arrows 21, because arrows 18 and 22 are orthogonal with arrows 20 and 21, the antenna will not receive the satellite signals. Please refer to FIG. 4, which is a block diagram of the hand-held communication device 10 when the second housing 14 is rotated 90 degrees. Arrow 24 is the normal direction of the antenna 11. In this case, the radio frequency signal reception of the antenna 11 can be optimized because arrow 24 is parallel with arrow 21. However, the antenna 11 still cannot receive the satellite signal transmitted from arrow 20 because arrow 20 is orthogonal to arrow 24.

Based on the observations above, it is known that the rotation axle 16 added to the hand-held communication device can only let the antenna do two-dimensional rotation. In this way, a satellite signal transmitted from some directions (e.g. arrow 20) cannot be received unless the user changes the position of the hand-held communication device 10. However, sometimes the user cannot change the position of the hand-held communication device for some reason, so the radio frequency signal reception of the antenna 11 cannot be optimized.

SUMMARY OF THE INVENTION

The claimed invention discloses a hand-held communication device with a rotatable antenna.

The hand-held communication device comprises a first housing, a rotation axle coupled to the first housing in a rotatable manner, a second housing coupled to the rotation axle in a rotatable manner, an antenna installed inside the second housing for transceiving a radio-frequency signal, and a signal-line coupled to the antenna for transmitting the radio-frequency signal.

These and other objectives of the claimed invention will no doubt become obvious to those of ordinary skill in the art after reading the following detailed description of the preferred embodiment that is illustrated in the various figures and drawings.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
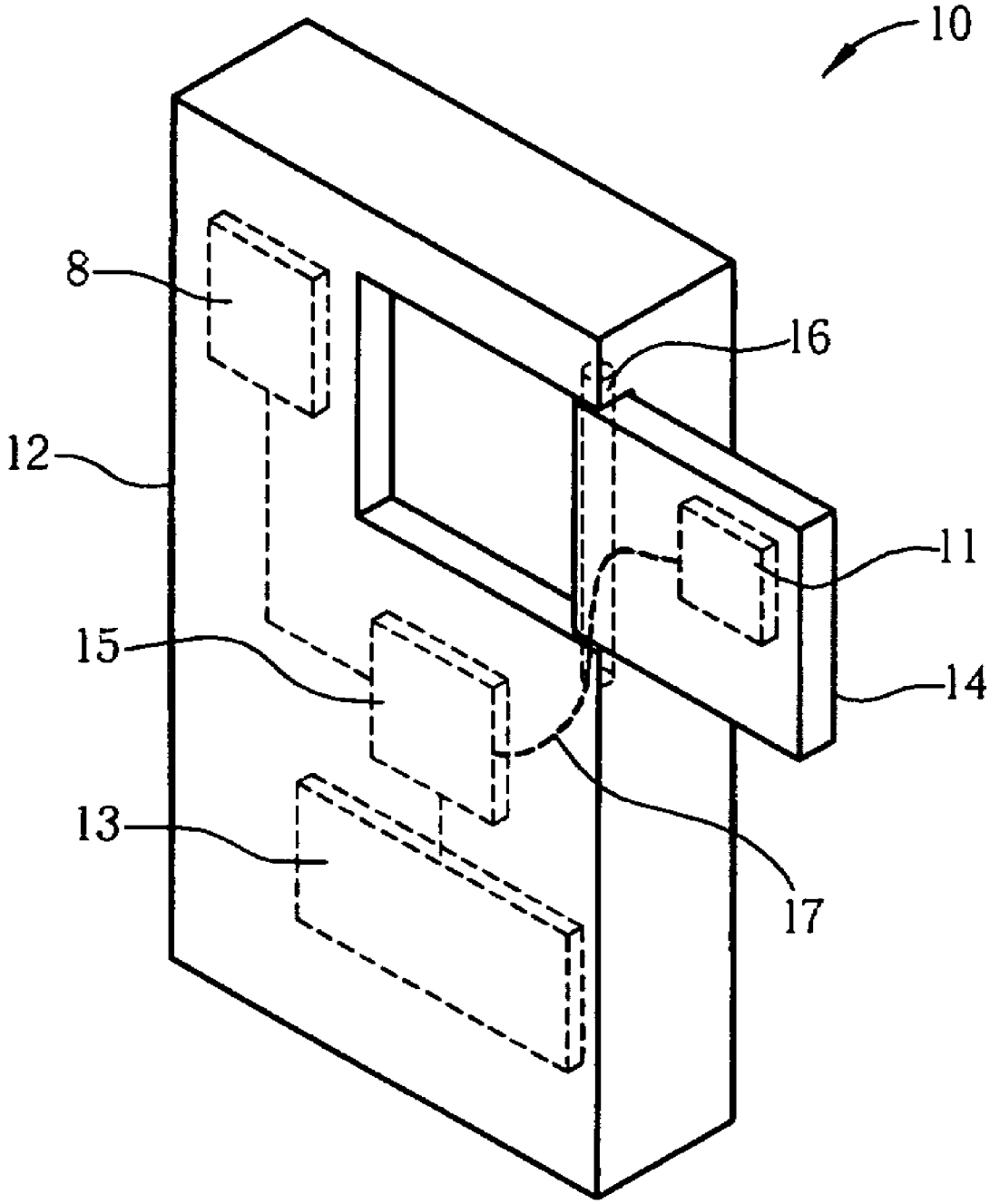
Fig. 1 Prior art
FIG. 1 illustrates a block diagram of the hand-held communication device with global position system according to the prior art.
Figure 2:
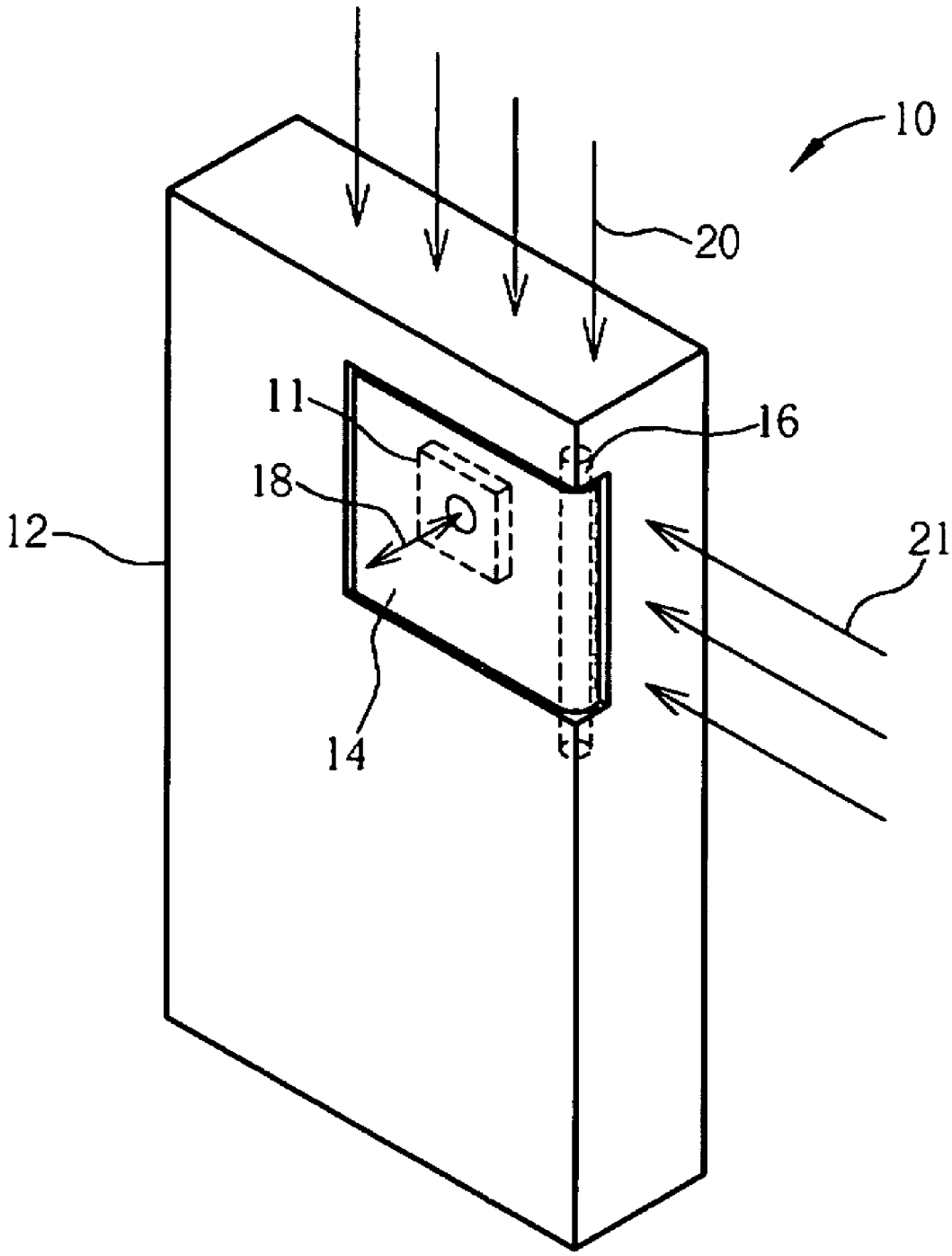
Fig. 2 Prior art
FIG. 2 illustrates a block diagram of the hand-held communication device according to FIG. 1 under the condition that the second housing rotated zero degree.
Figure 3:
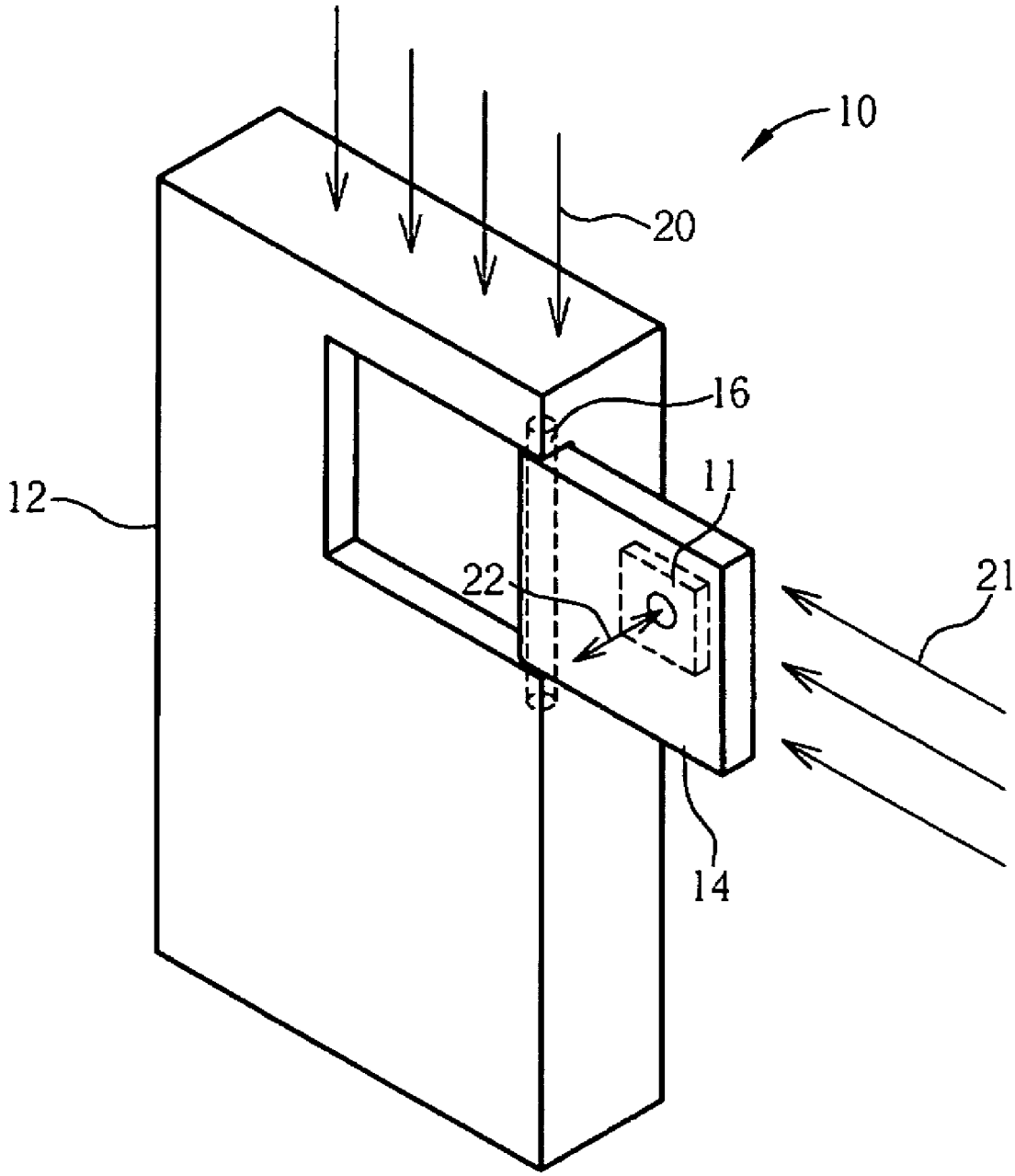
Fig. 3 Prior art
FIG. 3 illustrates a block diagram of the hand-held communication device according to FIG. 1 under the condition that the second housing rotated one hundred and eighty degrees.
Figure 4:
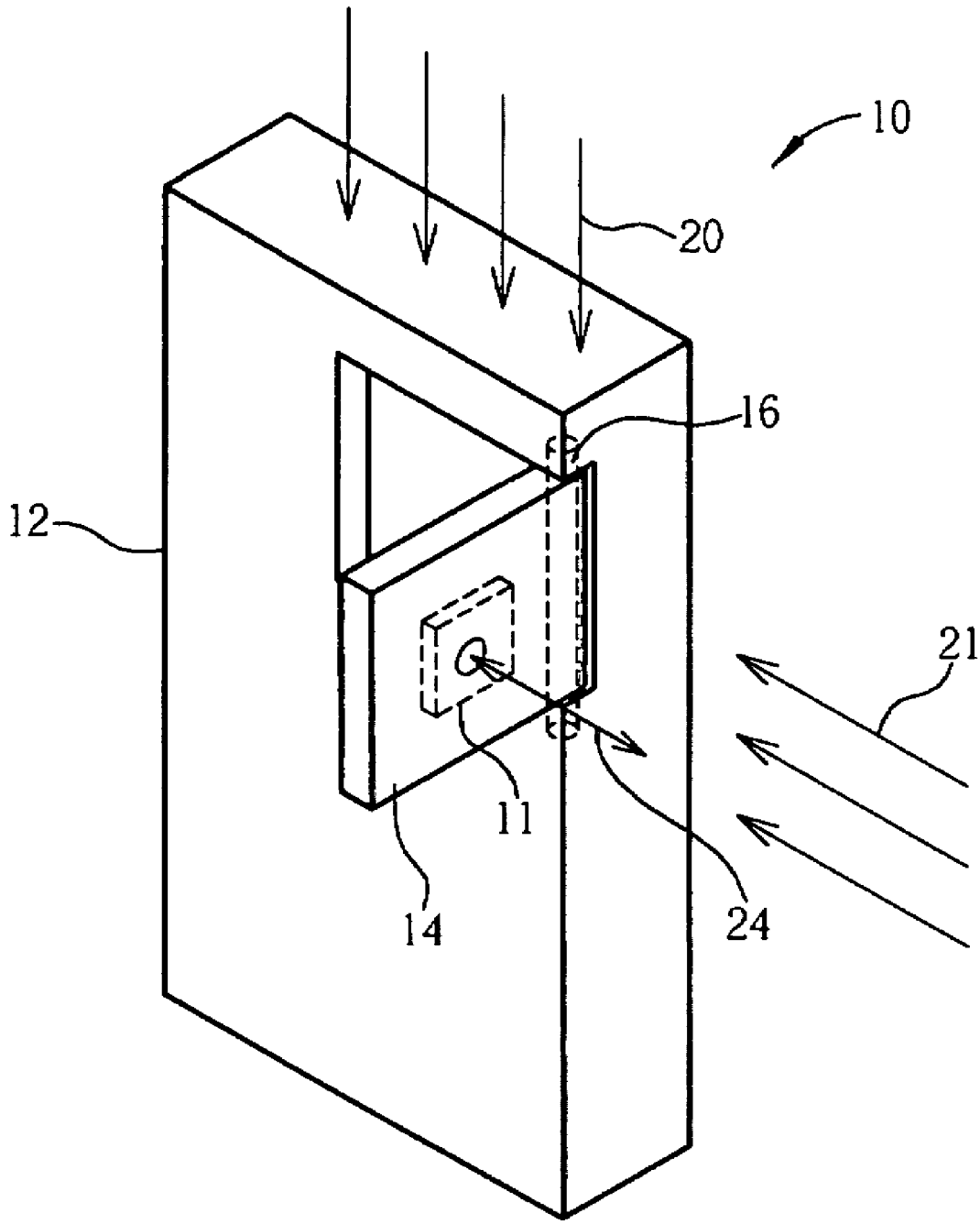
Fig. 4 Prior art
FIG. 4 illustrates a block diagram of the hand-held communication device according to FIG. 1 under the condition that the second housing rotated ninety degrees.
Figure 5:
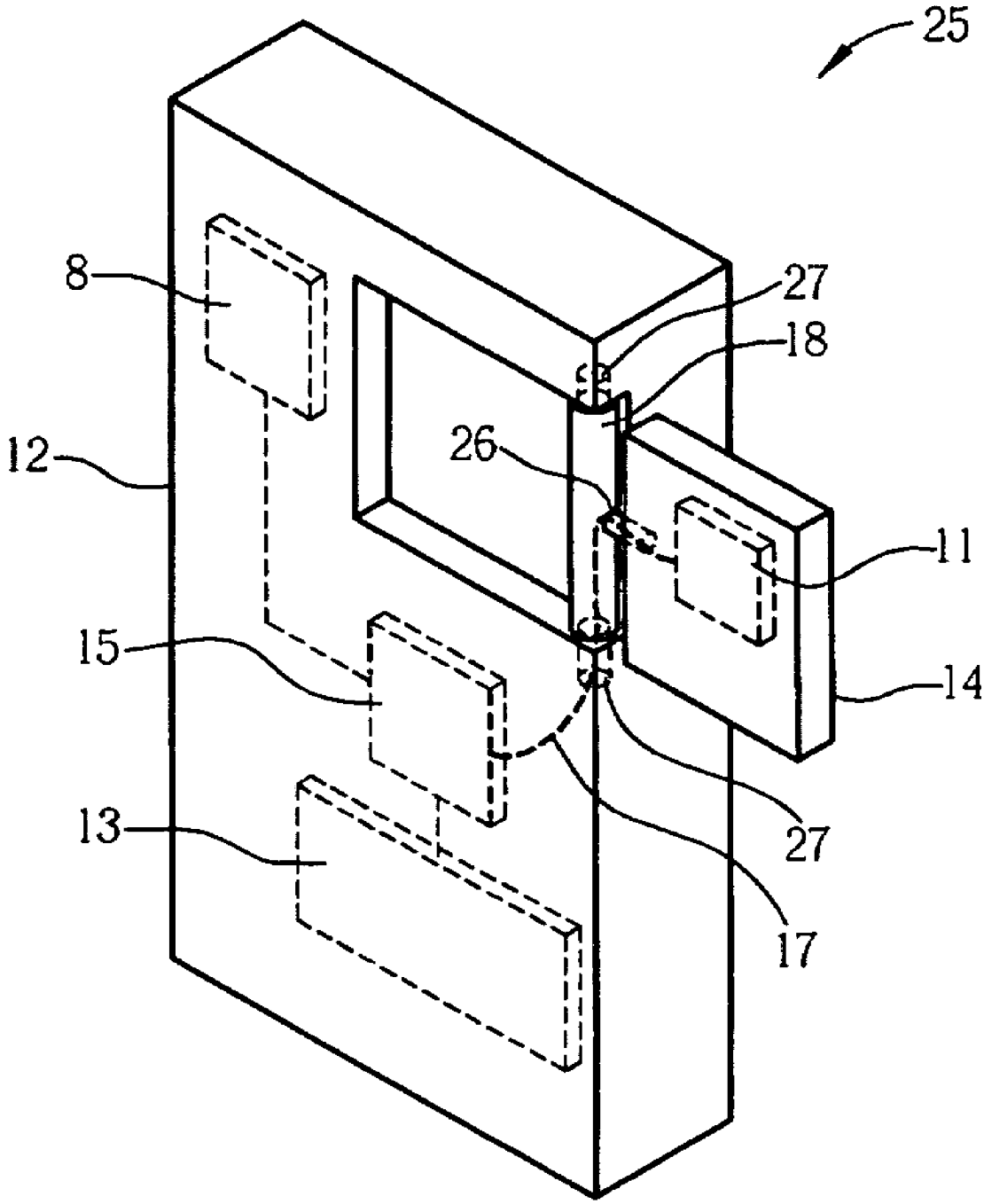
FIG. 5-7 illustrates a block diagram of the hand-held communication device according to the embodiment of the present invention.

Please refer to FIG. 5. FIG. 5 illustrates a block diagram of a hand-held communication device 25 according to the embodiment of the present invention. The hand-held communication device 25, which can be either a personal data assistant or a wireless cellular phone, comprises at least a first housing 12, a processor 13, a transceiver 15, a rotation axle 18, a second housing 14, a signal line 17, and at least one second pin 27, each pin 27 having ends connected to the rotation axle 18 and the first housing 12 in order to let the second housing 14 having the antenna rotate one 180 degrees horizontally. The hand-held communication device 25 further comprises a first pin 26 having ends connected to the rotation axle 18 and the second housing 14 in order to let the second housing 14 rotate one 180 degrees with respect to the rotation axle 18. With the aid of the rotation axle 18 and the first pin 26, the second housing 14 can achieve three-dimensional rotation so that the radio frequency signal reception of the antenna 11 can be optimized.

Figure 6:
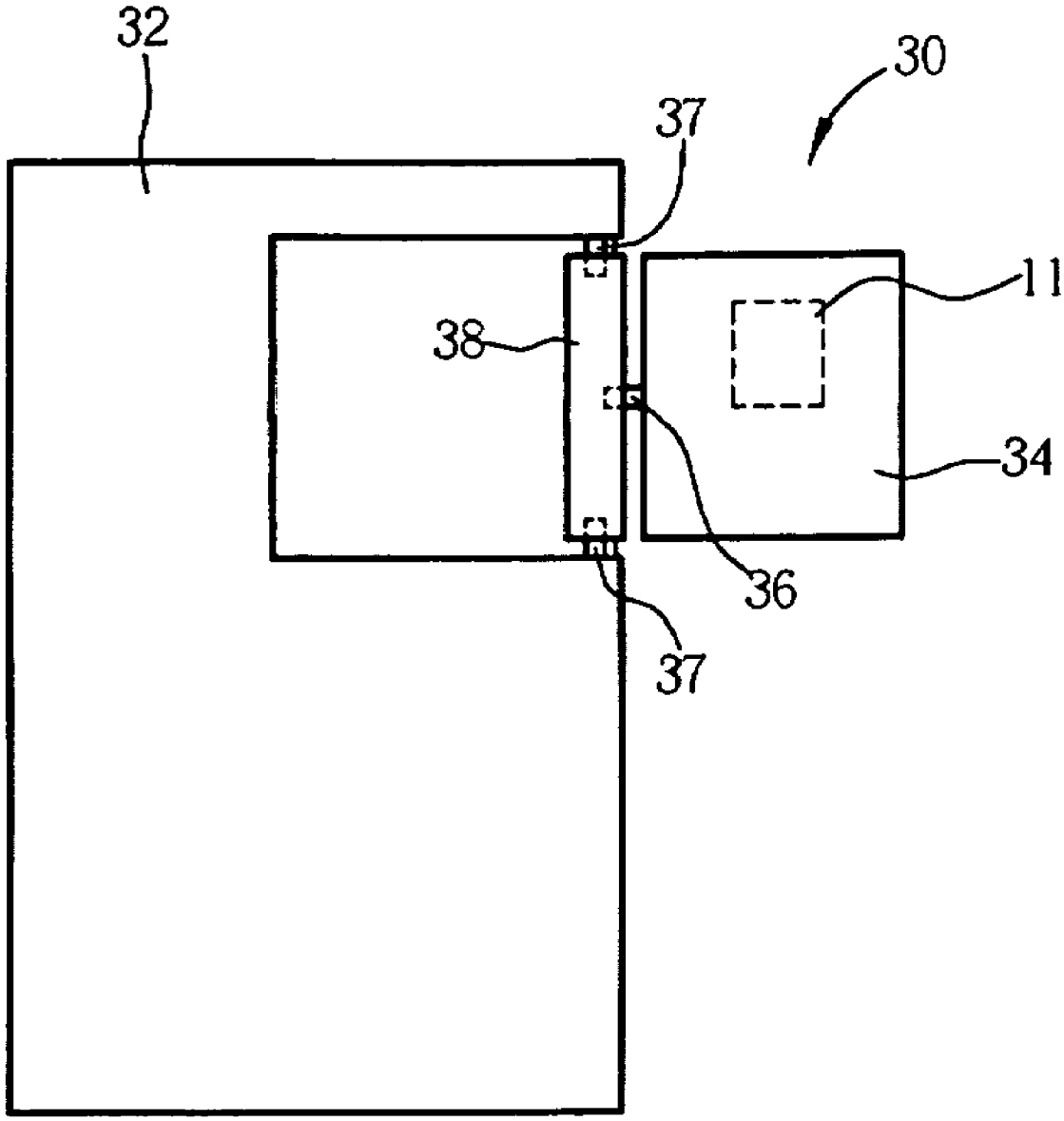
Figure 7:
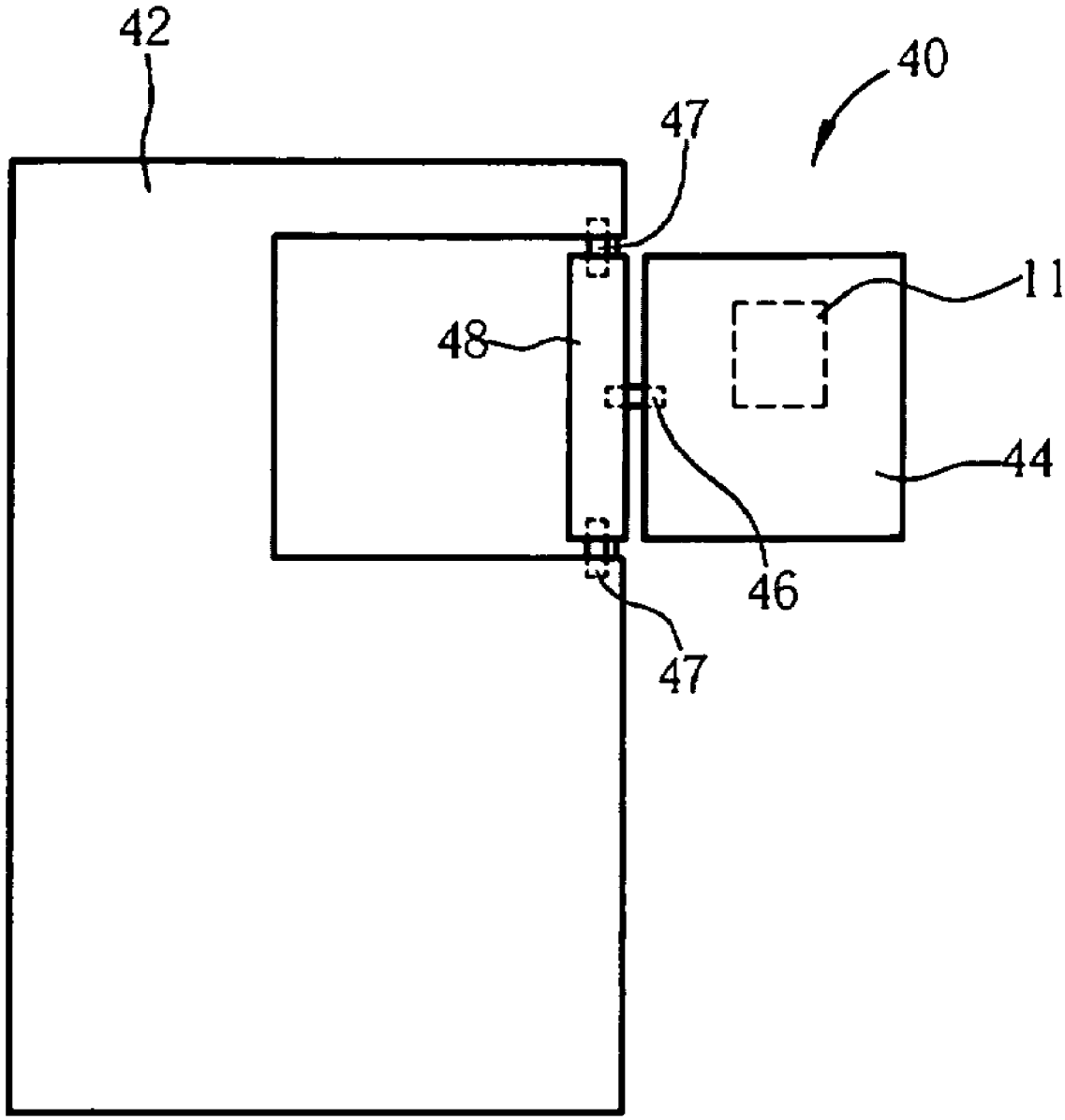

There are three ways for the first housing 12 to be connected with the second pin 27 and the rotation axle 18. The first way is shown by the held-held communication device 25 displayed in FIG. 5, where the second pin 27 is extended from the rotation axle 18 and inserted into the corresponding holes of the first housing 12. The second way is shown by a held-held communication device 30 displayed in FIG. 6, where a second pin 37 is extended from a first housing 32 and inserted into the corresponding holes of a rotation axle 38. The third way is shown by a held-held communication device 40 displayed in FIG. 7, where a second pin 47 is not extended from a rotation axle 48 or a first housing 42 and instead one end of the second pin 47 is inserted into the corresponding hole of the first housing 42 and the other end is inserted into an element of the corresponding hole of the rotation axle 48. No matter which connection method is chosen from the above three ways, the second pin 27, 37, 47 can let the rotation axle 18, 38, 48 rotate with respect to the first housing 12, 22, 32.

There are three ways for the second housing 14 to be connected with the first pin 26 and the rotation axle 18. The first way is shown by the held-held communication device 25 displayed in FIG. 5, where the first pin 26 is extended from the rotation axle 18 and inserted into the corresponding holes of the second housing 14. The second way is shown by the held-held communication device 30 displayed in FIG. 6, where a first pin 36 is extended from a second housing 34 and inserted into the corresponding holes of rotation axle 38. The third way is shown by the held-held communication device 40 displayed in FIG. 7, where a first pin 46 is not extended from the rotation axle 48 or a second housing 44 and instead one end of the first pin 46 is inserted into the corresponding hole of the second housing 44 and the other end is inserted into an element of the corresponding hole of rotation axle 48. No matter which connection method is chosen from the above three ways, the first pin 26, 36, 46 can let the second housing 14, 34, 44 rotate with respect to the rotation axle 18, 38, 48.

Figure 8:
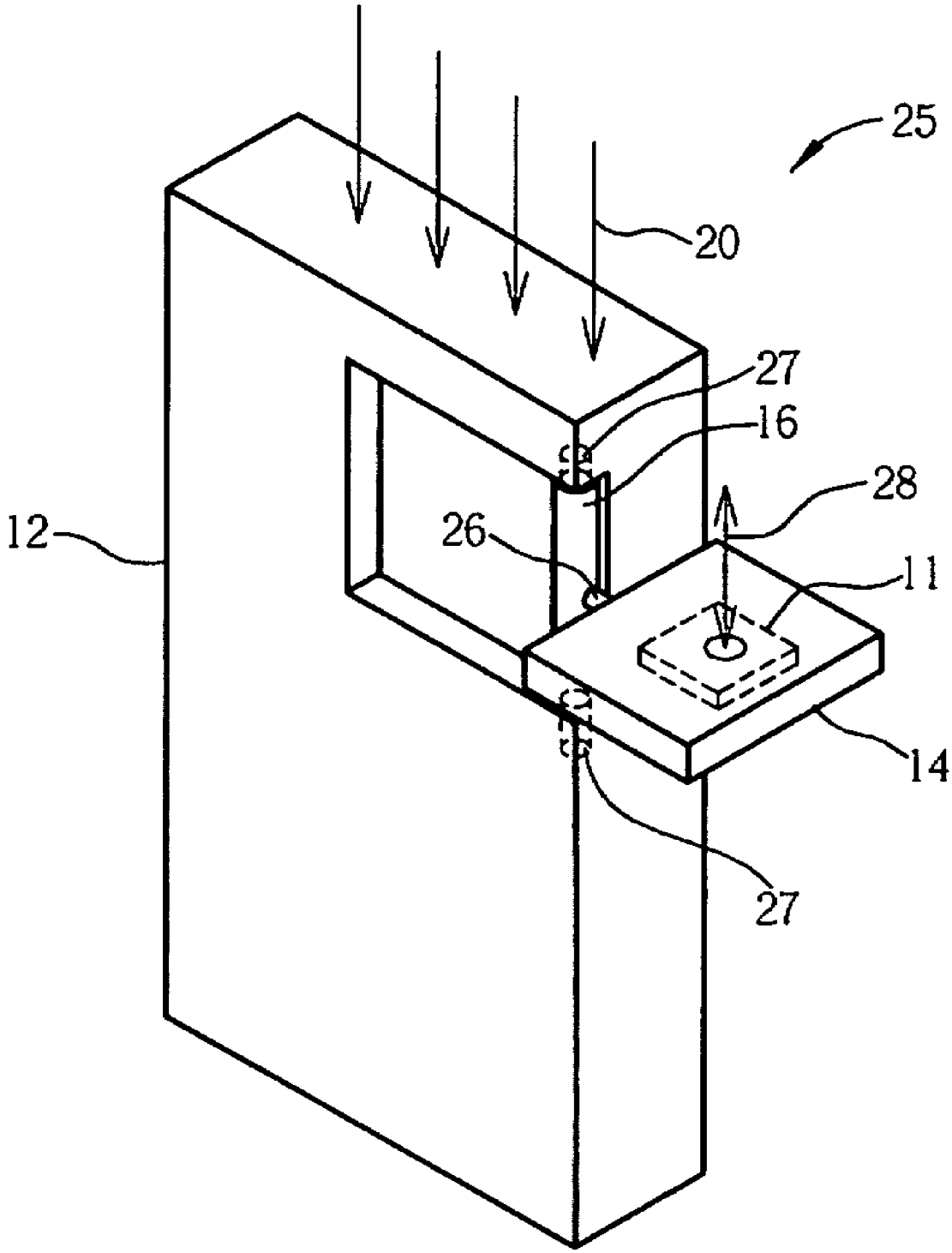
FIG. 8 illustrates a block diagram of the hand-held communication device according to FIG. 5 under the condition that the second housing rotated horizontally one hundred and eighty degrees and vertically ninety degrees in back direction.

Please refer to FIG. 8. FIG. 8 illustrates a block diagram of the hand-held communication device 25 according to the embodiment of the present invention when the second housing 14 is rotated horizontally 180 degrees and vertically 90 degrees backwards. An arrow 28 represents the normal direction of the antenna 11. Under this condition, because the arrow 28 is parallel with the arrow 20, the radio frequency signal reception of the antenna 11 transmitted along the arrow 20 can be optimized.

The first pin 26, 36, 46 of the hand-held communication device 25, 30, 40 of the present invention can let the second housing 14, 34, 44 having the antenna not only do two-dimensional rotation horizontally as the prior art achieves, but also do 180-degree rotation in a front-to-back direction. With any combination of the two rotation methods above, the second housing 14, 34, 44 can achieve three-dimensional rotation, that is, the antenna 11 can receive signals transmitted from any direction.

Those skilled in the art will readily observe that numerous modifications and alterations of the device may be made while retaining the teachings of the invention. Accordingly, the above disclosure should be construed as limited only by the metes and bounds of the appended claims.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A hand-held communication device with a rotatable antenna comprising:

a first housing;

a rotation axle coupled to the first housing in a rotatable manner;

a second housing coupled to the rotation axle in a rotatable manner through a first pin, the second housing capable of rotating about the first pin;

a second pin for coupling the first housing to the rotation axle for permitting the second housing to rotate about the rotation axle;

an antenna, installed inside the second housing, for transceiving a radio-frequency signal; and a signal-line, passing from the first housing through an interior of the second pin and coupled to the antenna, for transmitting the radio-frequency signal.

2. The hand-held communication device with a rotatable antenna of claim 1, wherein the first pin has one end coupled to the rotation axle and another end inserted into a corresponding hole of the second housing.

3. The hand-held communication device with a rotatable antenna of claim 1, wherein the first pin has one end coupled to the second housing and another end inserted into a corresponding hole of the rotation axle.

4. The hand-held communication device with a rotatable antenna of claim 1, wherein the first pin has one end inserted into a corresponding hole of the second housing and another end inserted into a corresponding hole of the rotation axle.

5. The hand-held communication device with a rotatable antenna of claim 1, wherein the second pin has one end coupled to the rotation axle and another end inserted into a corresponding hole of the first housing.

6. The hand-held communication device with a rotatable antenna of claim 1, wherein the second pin has one end coupled to the first housing and another end inserted into a corresponding hole of the rotation axle.

7. The hand-held communication device with a rotatable antenna of claim 1, wherein the second pin has one end inserted into a corresponding hole of the first housing and another end inserted to a corresponding hole of the rotation axle.

8. The hand-held communication device with a rotatable antenna of claim 1 being either a personal data assistant or a wireless cellular phone.

* * * * *